United States Patent [19]

Sinsky et al.

[11] Patent Number: 4,973,971

[45] Date of Patent: Nov. 27, 1990

[54] BROADBAND CIRCULAR PHASED ARRAY ANTENNA

[75] Inventors: Allen I. Sinsky, Baltimore; Joseph H. Acoraci, Phoenix; Carl B. Wischhusen, Jarrettsville, all of Md.

[73] Assignee: Allied-Signal Inc., Morris Township, Morris County, N.J.

[21] Appl. No.: 452,453

[22] Filed: Dec. 18, 1989

[51] Int. Cl.[5] ..... H01Q 3/22; H01Q 3/24; H01Q 3/26

[52] U.S. Cl. ..... 342/373; 342/360

[58] Field of Search ..... 342/373, 360

[56] References Cited

U.S. PATENT DOCUMENTS 4,316,192 2/1982 Acoraci .

4,414,550 11/1983 Tresselt ..... 343/373

4,641,142 2/1987 Greving et al. ..... 342/399

4,652,879 3/1987 Rudish et al. ..... 342/373

*Primary Examiner*—Theodore M. Blum

*Attorney, Agent, or Firm*—Howard G. Massung; Robert A. Walsh

[57] ABSTRACT

An apparatus and method for generating a directional beam for radiating or receiving electromagnetic signals having a constant beamwidth over a predetermined frequency range has been described incorporating a circular array antenna, a Butler matrix, a plurality of phase shifters, a plurality of transmission line lengths, and a power divider. The invention overcomes the problem of constant beamwidth over a predetermined frequency range such as one and one half octaves.

5 Claims, 8 Drawing Sheets

BROADBAND CIRCULAR PHASED ARRAY ANTENNA

BACKGROUND OF THE INVENTION

Cross-Reference To Related Application

Cross reference is herein made to U.S. Ser. No. 669,555 filed Nov. 8, 1984 entitled "Low Profile Array Antenna System With Independent Multibeam Control" by C. P. Tresselt which is directed to a circular array antenna wherein each antenna element is coupled to two Butler matrixes. Each Butler matrix is coupled through respective phase shifters to respective beam forming networks and wherein the control input of respective phase shifters are coupled to respective steering command generators.

FIELD OF THE INVENTION

This invention relates to a circular phased array antenna fed by a Butler matrix, and more particularly, to phase compensation as a function of frequency at the input modes of the Butler matrix.

DESCRIPTION OF THE PRIOR ART

Present Butler matrix type circular phased array antennas that are used to produce directional antenna beams operate over a narrow frequency band. Recent applications using Butler matrix type circular phased array antennas have been for radar beacon systems including interrogation friend or foe (IFF) systems which require only a few percent bandwidth. Butler matrix type circular phased array antennas could have many applications, for example, electronic warfare (EW) systems if a directional antenna beam could be produced over a broad bandwidth, for example, one (1) octave.

In U.S. Pat. No. 4,743,911 which issued on May 10, 1988 to G. E. Evans, entitled "Constant Beamwidth Antenna" an array antenna feed system is described which provides constant beamwidth over a large bandwidth of operating frequencies. The signal to be fed to the array antenna is divided into a correction signal and a basic signal by a frequency sensitive splitter. The magnitudes of the basic and correction signals vary with frequency and are displaced from each other by a quarter cycle on the frequency scale. The correction and basic signals are combined in series or with corporate coupler arrays to drive the individual antenna elements. In receiving applications, the splitter functions to combine the correction and basic signals from the corporate coupler array to provide a combined signal to the receiver input.

In U.S. Pat. No. 4,639,732 which issued on Jan. 27, 1987 to J. H. Acoraci and A. W. Moeller entitled "Integral Monitor System for Circular Phased Array Antenna", a beam steering control unit is shown coupled to the control inputs of a plurality of phase shifters. The phase shifters are shown coupled between a power divider and a Butler matrix and are used for steering the antenna beam.

In U.S. Pat. No. 4,425,567 which issued on Jan. 10, 1984 to C. P. Tresselt entitled "Beam Forming Network for Circular Array Antennas", a beam forming network is shown. Further, a steering circuit is shown coupled to phase shifters for changing the phase of the signals originating from a beam forming network and coupled to the input modes of a Butler matrix.

In U.S. Pat. No. 4,414,550 which issued on Nov. 8, 1983 to C. P. Tresselt entitled "Low Profile Circular Array Antenna and Microstrip Elements Therefor", an antenna element comprised of two rectangular microstrip patch dipoles above a ground plane conductor is described. Further, a plurality of phase shifters controlled by a steering command is shown coupled between the beam forming network and the input modes of a Butler matrix for steering the beam in azimuth around the circular array antenna.

In U.S. Pat. No. 4,316,192 which issued on Feb. 16, 1982 to J. H. Acoraci entitled "Beam Forming Network for Butler Matrix Fed Circular Array", a circular multimode antenna array is shown having a steering circuit coupled to a plurality of phase shifters which shift the phase of the signals from a beam forming network which are coupled to the input modes of a Butler matrix.

In U.S. Pat. No. 4,128,839 which issued on Dec. 5, 1978 to A. D. McComas entitled "Means For Accumulating Aircraft Position Data for a Beacon Based Collision Avoidance System and Other Purposes", a plurality of phase shifters are shown positioned between a passive beam forming network and the input modes of a Butler matrix having its output coupled to a circular antenna array. Steering commands are shown coupled to a phase shifter decoder and driver which in turn is coupled to six phase shifters for steering the antenna pattern around the circular antenna array in azimuth.

In a paper entitled, "A Matrix-Fed Circular Array for Continuous Scanning" by B. Sheleg, Proc. IEEE. volume 56 no. 11, November, 1968, pp. 2016–2027, a Butler matrix-fed circular array was described for forming a focused radiation pattern when the proper current distribution is-established on the inputs to the matrix.

SUMMARY OF THE INVENTION

In accordance with the present invention, an apparatus and method is provided for generating a directional beam having a constant beamwidth over a predetermined frequency bandwidth comprising a circular array antenna, a Butler matrix coupled to the antenna, a plurality of phase shifters, a plurality of transmission line lengths, and a beam forming network or power divider having at least one input and a plurality of outputs for generating the directional beam, each output of the power divider having a predetermined power attenuation with respect to at least one input, each respective output of the power divider coupled in series through a respective phase shifter and a respective transmission line length for providing a predetermined phase decrease as a function of frequency of signals at the respective input mode of the Butler matrix.

The invention further provides a plurality of transmission line lengths interconnected between the power divider and the Butler matrix to provide phase compensation as a function of frequency at the input modes of the Butler matrix.

The invention further provides a circular phased array antenna with a Butler matrix having broad band performance, for example, 1.5 octaves.

The invention further provides a circular phased array antenna fed by a Butler matrix having a constant beam direction and beamwidth over a broad band.

The invention further provides a circular phased array antenna fed by a Butler matrix with broadband performance with no inherent losses except for ohmic losses due to conductors and dielectric materials.

The invention further provides a method for empirically determining the transmission line lengths required to provide a predetermined phase decrease as a function of frequency at the input to the Butler Matrix.

DESCRIPTION OF THE PREFERRED EMBODIMENTS

Figure 1:
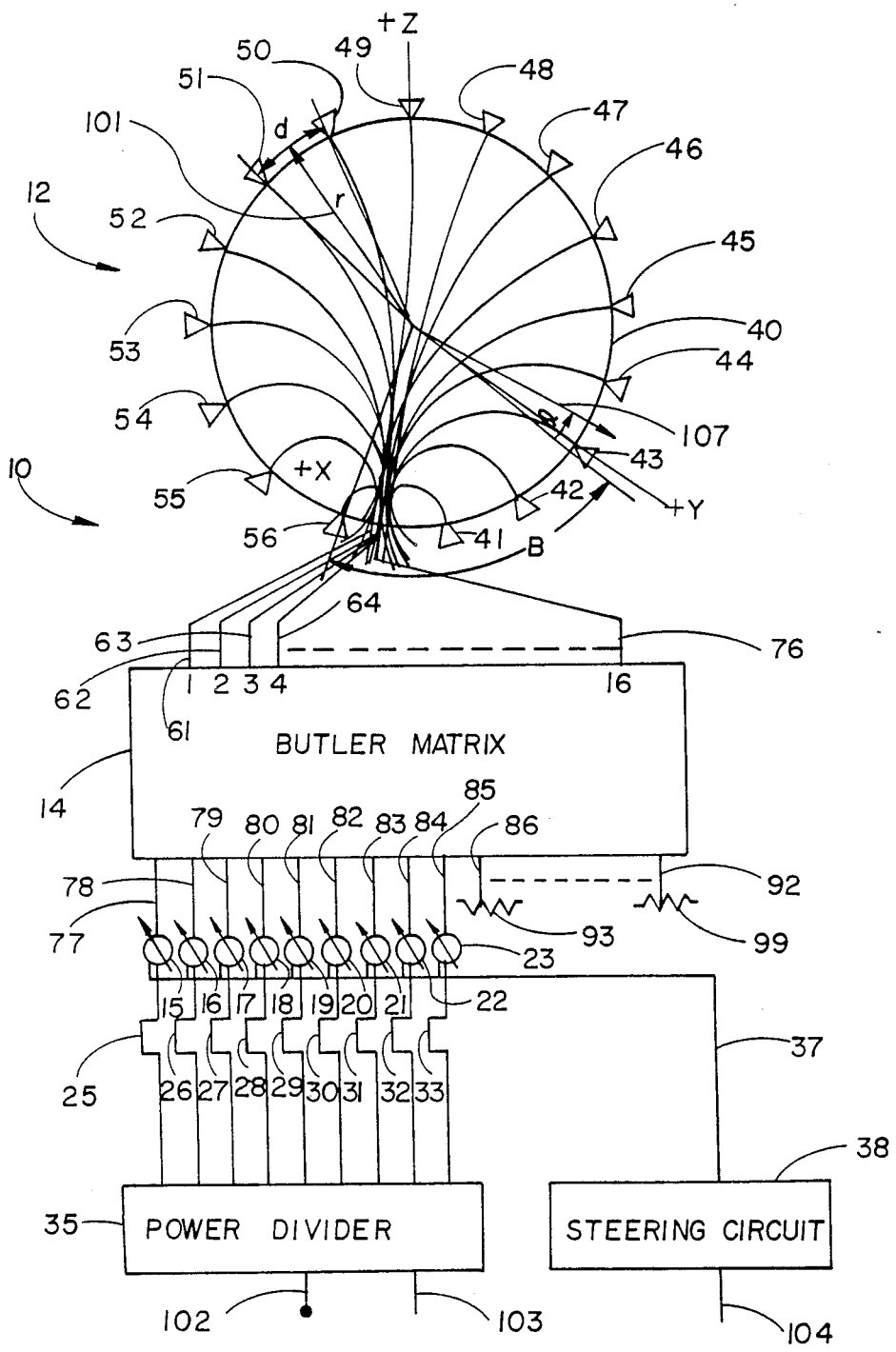
FIG. 1 is one embodiment of the invention.

Referring to FIG. 1, a circular array antenna system 10 is shown for generating a directional beam having a constant beamwidth over a predetermined frequency bandwidth. Circular array antenna system 10 includes a circular array antenna 12, Butler matrix 14, phase shifters 15–23, transmission line lengths 25–33 and power divider 35. Phase shifters 15–23 may be, for example, six-bit phase shifters to provide selected variable phase shifts in signals at the inputs of the Butler Matrix in increments of 5.625 degrees of electrical phase. Steering circuit 38 functions to send the selected phase settings over steering command lines 37 to cause phase shifters 15–23 to provide selected phase shifts. The variable phase shift provided by the phase shifters 15–23 will steer a directional beam in azimuth around circular array antenna 12.

Antenna array 12 may include a ground plane 40 and antenna elements 41–56 mounted thereon for radiating electromagnetic energy in azimuth at an angle $\alpha$ and in elevation at an angle $\beta$ as shown in FIG. 1. Coordinates X, Y and Z are orthogonal to one another. Coordinates X and Y are in the plane of antenna elements 41 through 56.

Butler matrix 14 may have sixteen output terminals 61–76 which are coupled to respective antenna elements 41–56. Phase shifters 15–23 are coupled over leads 77–85 respectively to input modes of Butler matrix 14. Unused input modes are coupled over leads 86 through 92 to respective terminating resistors 93 through 99. Lead 77 is coupled to mode 0. Lead 78 is coupled to mode plus 1. Lead 79 is coupled to mode minus 1. Lead 80 is coupled to mode plus 2. Lead 81 is coupled to mode minus 2. Lead 82 is coupled to mode plus 3. Lead 83 is coupled to mode minus 3. Lead 84 is coupled to mode plus 4. Lead 85 is coupled to mode minus 4.

Circular array antenna 12 may have antenna elements 41–56 evenly spaced along a circle having a radius R as shown by arrow 101 and may have antenna element spacing d as shown by arrow 100.

Power divider 35 has an input lead 102 which may couple microwave power, for example, for a sum pattern and lead 103 which may couple microwave power, for example, for a difference pattern. Power divider 35 functions to divide the power on a respective input lead 102 or 103 to provide weights on the output lines going to transmission line lengths 25–33. The amplitude weights or power division results in a predetermined pattern at a particular frequency being formed from circular array antenna 12. The pattern may be steered through an angle by a progressive linear phase change produced on phase shifters 15–23 in response to control signals on lead 37 from steering circuit 38. An input to steering circuit 38 on lead 104 may determine the desired steering angle for the beam pattern provided by power divider 35.

Predetermined and in general different transmission line lengths 25–33 provide a predetermined phase decrease as a function of an increase of frequency of the signal passing through each respective transmission line length.

In operation for single frequency operation of circular array antenna system 10, phase shifters 15–23 in addition to providing phases to steer the directional beam, provide a fixed phase offset that is the negative of the mode bias phase. The fixed phase offset serves to cancel the mode bias phase, since the sum of the fixed phase offset and the mode bias phase will be zero. The fixed phase offsets of phase shifters 15–23 are constant with frequency. The mode bias phases vary with frequency. When circular array antenna 12 is operated at a different frequency, the resulting directional beam significantly defocuses and broadens since the fixed phase offset no longer equals the negative of the mode bias phase and hence no longer cancels the mode bias phase.

In order to keep the directional beam focused, a specific set of fixed phase offsets are required at each frequency. Analysis shows that the mode phase bias is a substantially linear function of frequency for each of the several modes. The slope of each respective mode phase versus frequency graph is in general different. A line length, for example, a radio frequency (R.F.) cable or transmission line, has a phase versus frequency characteristic curve which is linear and the slope of this curve is proportional to the length. Therefore, an appropriate transmission line length placed at each input mode to the Butler matrix will have a phase compensating effect that keeps the directional beam from the circular array antenna 12 focused at different frequencies i.e. over a broad bandwidth.

In order to maintain the same mode excitations required to produce the desired antenna pattern as determined by power divider 35, it is first necessary to cancel the mode bias phases. The mode bias phase is a fixed phase shift at each particular frequency. The mode bias however changes substantially as a function of frequency. When referenced to the array center the mode bias $V_l(\alpha,\beta)$ is given by equation 1.

$$V_l(\alpha,\beta) = (1/\sqrt{N}) \sum_{i=1}^{N} G_i \exp j(2\pi il/N + \gamma_i) \quad (1)$$

Mode bias is defined as the complex far field voltage, referenced to the array center, resulting from excitation of the $l^{th}$ mode input of the Butler Matrix 14. The mode input excitation has unity amplitude and zero phase when computing mode bias. The mode biases are computed for each mode input at a particular value of $\alpha$ and $\beta$. If the mode excitations are set proportional to the reciprocal of the mode biases, then each mode taken one at time will produce unity voltage in the directions, $\alpha,\beta$.

For example, if the mode bias is given by equation 1.1

$$V_l = A_l e^{j\phi l} \quad (1.1)$$

then the ideal mode bias correction is given by equation 1.2

$$\frac{1}{V_l} = \frac{1}{A_l} e^{-j\phi l}. \quad (1.2)$$

The amplitude $A_l$ is not presently described as being corrected herein because the amplitude mainly affects the sidelobes and not the gain or beamwidth of the main beam, for example, a sum beam.

Further, a device is not currently available to correct the amplitude as a function of frequency without incurring unacceptable RF power losses. The phase $\phi_l$ may be corrected as described herein because it keeps the beamwidth and gain of the main beam constant over frequency. Correction of the phase $\phi_l$ may be achieved without loss of power by using transmission lines as described herein.

In equation 1, $G_i$ equals the voltage gain of the $i^{th}$ antenna element in the direction, $\alpha,\beta$, shown in FIG. 1 by arrow 107. Each antenna element pattern may have a boresight direction $B_i$, which is rotated by an angle $\beta_s$ with respect to the original angle $\beta$ and tilted up in elevation by angle $\alpha_s$ with respect to the original angle $\alpha$. The angles $\alpha_s$ and $\beta_s$ are commonly referred to as squint angles with respect to the $\alpha$ and $\beta$ angles. The angles $\alpha_s$ and $\beta_s$ originate at the $i^{th}$ antenna element. $G_i$ is given in equation 2

$$G_i = 1 + KX_i \quad (2)$$

Where K is given in equation 3 and $X_i$ is given in equation 4.

Where:

$$K = (10^{FB/20} - 1)/(10^{FB/20} + 1) \quad (3)$$

$$X_i = \cos\alpha \cos\alpha_s[\cos(\beta - \phi_i - \beta_s)] + \sin\alpha \sin\alpha_s \quad (4)$$

In equation 3, FB equals the ith antenna element front to back ratio or maximum to minimum ratio in decibels (dB). In equation 4, $\phi_i$ is given by equation 5.

$$\phi_i = 2\pi i/N \quad (5)$$

In equation 5, i equals the ith element starting from the X axis and going counterclockwise around the array and N is the number of antenna elements associating with circular array antenna 12.

In equation 1, $\gamma_i$ is equal to the spatial phase of the ith antenna element referenced to the center of circular array antenna 12 and is given in equation 6.

$$\gamma_i = R(2\pi/\lambda) \cos\alpha[\cos(\beta - \phi_i)] \quad (6)$$

In equation 6, R is equal to the radius of circular array antenna 12. $\lambda$ is equal to the wavelength in inches of the signal to be radiated. $\lambda$ in inches may be expressed as 12*983.573/f where f is a frequency in megahertz.

As can be seen by inspecting equations 6 and 1 the mode phase bias $V_1(\alpha,\beta)$ changes with frequency of the signal being radiating.

Figure 2A:
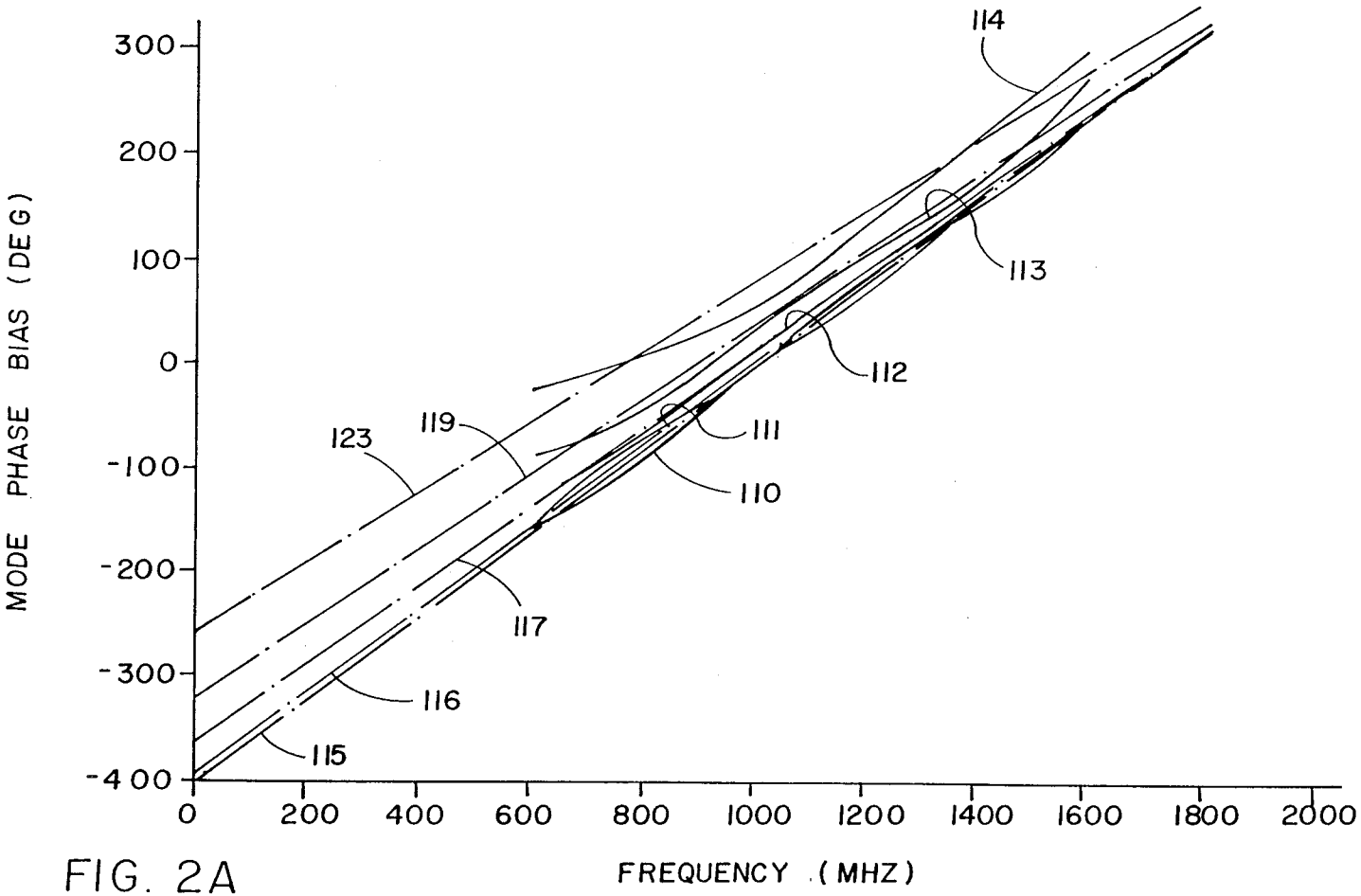
FIG. 2A is a graph of the mode phase bias versus frequency.
Figure 2B:
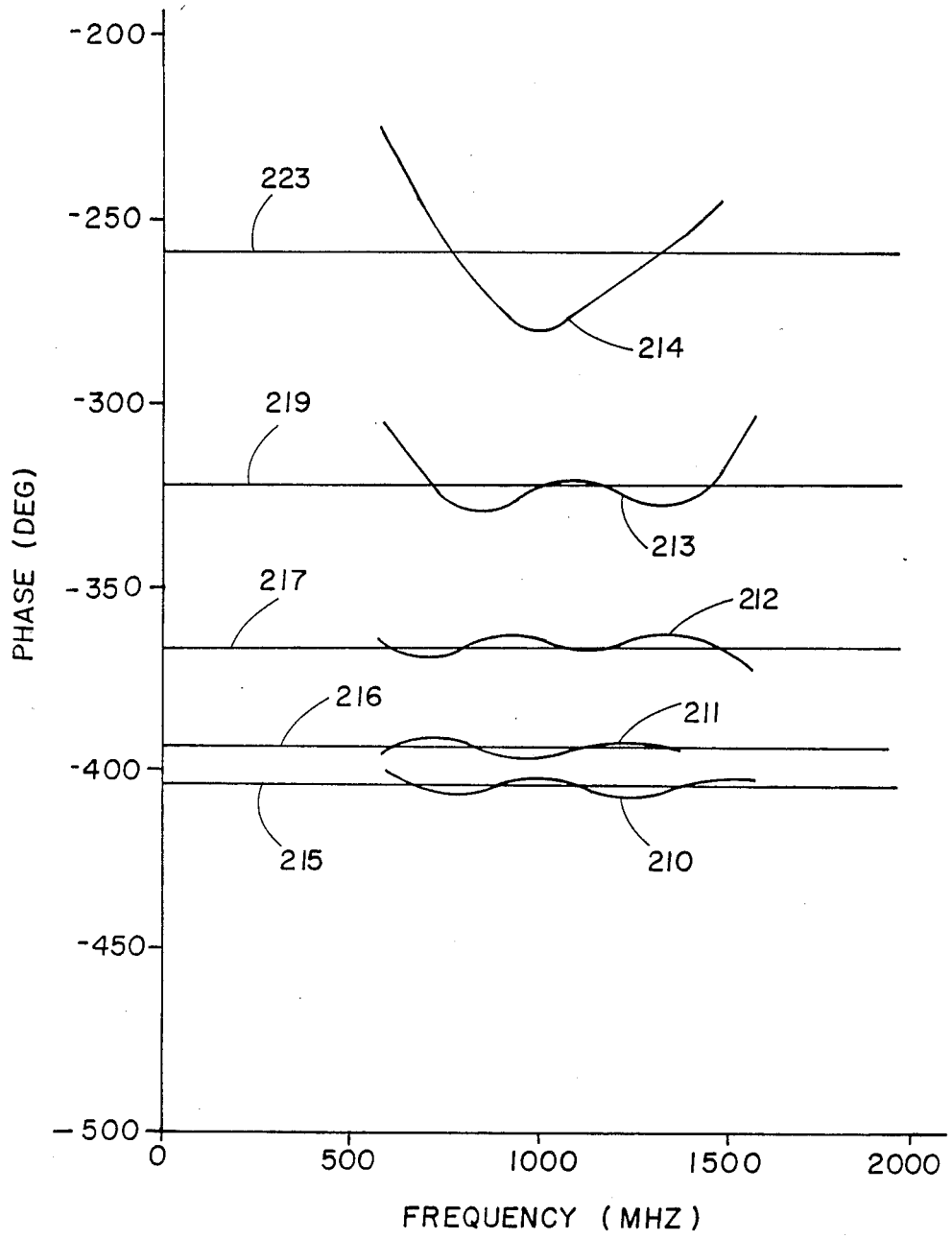
FIG. 2B is a graph of the mode phase bias versus frequency after phase slope compensation.
Figure 2C:
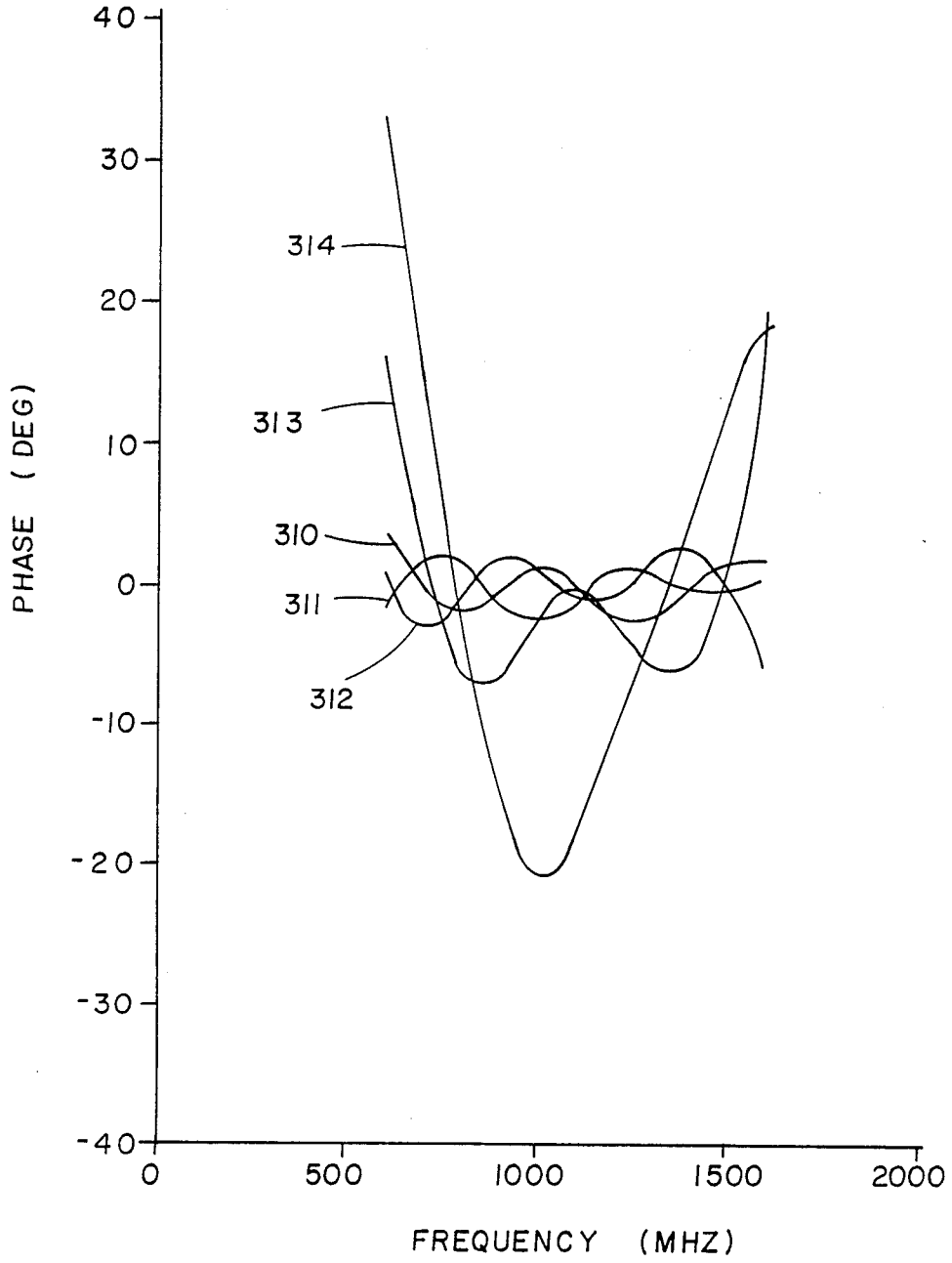
FIG. 2C is a graph of the mode phase bias versus frequency after phase slope compensation and phase offset.

FIGS. 2A–2C are graphs of the mode phase bias versus frequency of the signal being radiated for an embodiment similar to that shown in FIG. 1. In FIGS. 2A–2C, the ordinate represents mode phase bias in degrees and the abscissa represents frequency in megahertz. Curves 110–114 were calculated using equation 1 where the radius of the circular array antenna was 33.02 centimeters (13 inches) and the phase was referenced to the center of the circular array antenna where the azimuth angle $\beta$ and the elevation angle $\alpha$ equals zero. The element pattern for each antenna element was computed from equation (2) using a front to back ratio (FB) of 100 dB. Curves 110–114 correspond to the excitation of mode 0, mode 1, mode 2, mode 3, and mode 4 respectively. Reference line 115 is a straight line approximation of curve 110 and has a slope of 0.398 degrees per Mhz. Reference line 116 is a straight line approximation of curve 111 and has a slope of 0.392 degrees per Mhz. Reference line 117 is a straight line approximation on of curve 112 and has a slope of 0.376 degrees per Mhz. Reference line 119 is a straight line approximation of curve 113 and has a slope of 0.355 degrees per Mhz. Reference line 123 is a straight line approximation of curve 114 and has a slope of 0.333 degrees per Mhz.

The phase of a signal exiting a transmission line with respect to its input is given by equation 7, $$\phi = -360 \frac{lf}{c} \quad (7)$$

where 1 is the length of the transmission line, f is the frequency and c is the velocity of the signal in the transmission line. By differentiating with respect to frequency, $d\phi/df$ may be expressed as given in equation 8.

$$\frac{d\phi}{df} = -360 \frac{l}{c} \quad (8)$$

If $l_o$ is the length in freespace, then 1 in coax cable for example is given by equation 9

$$l = \frac{l_o}{\sqrt{\epsilon_r}} = \frac{-c}{360} \frac{d\phi}{df} \quad (9)$$

where $\epsilon_r$ is the relative permitivity which for teflon loaded coax cable equals about 2.1.

Table 1 provides the value of $d\phi/df$ as provided by reference lines 115, 116, 117, 119 and 123 in FIG. 2 for respective modes 0, 1, 2, 3 and 4. The corresponding length of transmission line or cable to provide a negative $d\phi/df$ equal to the positive $d\phi/df$ is given in Table 1 in inches.

TABLE I

| Mode | (deg/Mhz) $d\phi/df$ | Transmission line length | Differential line length |
|---|---|---|---|
| 0 | .398°/MHz | 22.89 cm (9.01") | 3.73 cm (1.47") |
| ±1 | .392 | 22.53 cm (8.87") | 3.38 cm (1.33") |
| ±2 | .376 | 21.62 cm (8.51") | 1.19 cm (.47") |
| ±3 | .355 | 20.42 cm (8.04") | 1.27 cm (.5") |
| ±4 | .333 | 19.15 cm (7.54") | 0 cm (0") |

Thus, by inserting a predetermined transmission line length at the input of each mode of the Butler matrix, the electrical effect is to make the mode phase versus frequency constant thus the new curves 210–214 corresponding to curves 110–114 in FIG. 2A would be horizontal as shown in FIG. 2B. By inserting a fixed phase shift, the curves 210–214 shown in FIG. 2B may be moved vertically on the graph shown in FIG. 2B to overlap one another as shown in FIG. 2C by curves 310–314 thereby completely normalizing the mode phase of the Butler matrix with respect to frequency. It is only necessary to insert transmission line lengths into each mode input whose differential lengths are as noted in Table I. Since mode 4 has the shortest line length it can be chosen as zero differential length. The weights provided by power divider 35 will therefore generate a pattern from the circular array antenna which will not change with respect to frequency. By inserting transmission line lengths having an equal but negative slope with respect to reference lines 115–117, 119 and 123 the difference in mode phase will be the difference between the reference lines 115–117, 119 and 123 and curves 110–114 respectively in FIG. 2A which is the same as the difference between the reference lines 215–217, 219 and 223 and curves 210–214. The reference lines are straight line approximations of the curves respectively.

Instead of calculating the mode phase bias vs. frequency using equation 1 , the mode phase bias vs. frequency as shown in FIG. 2A may be determined empirically by exciting each mode of the Butler matrix, leads 77–85, and measuring the phase at a particular point in space in the far field with respect to the circular array antenna. Alternately, a signal may be radiated at a particular point in space in the far field with respect to circular array antenna 12 and the phase of the received signal measured at each mode input, leads 77–85, of the Butler matrix.

Further, exact compensation for each mode phase may be empirically determined by utilizing transmission line stretchers for transmission line lengths 25–33 at the input of each mode of the Butler matrix which would be varied in length by manual adjustment between far field measurements to obtain the same mode phase versus frequency slope for each mode. The transmission line stretchers may be left permanently at the inputs of the Butler matrix and the transmission line lengths may be secured by fastening the transmission line stretchers at the length where the change in mode phase over frequency is the same for each mode.

Figure 3:
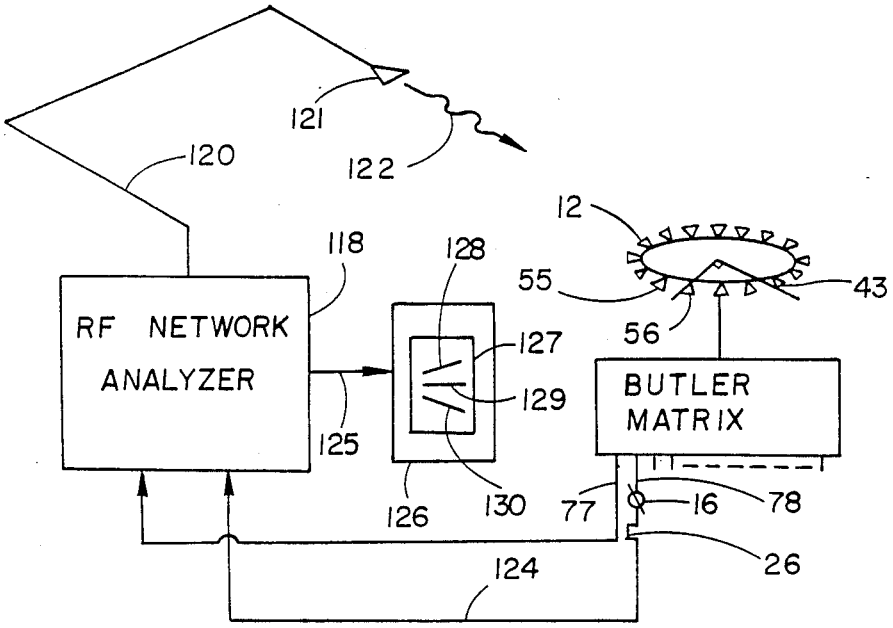
FIG. 3 is a block diagram of the test set-up for measuring the data obtained in FIG. 4A.
Figure 4:
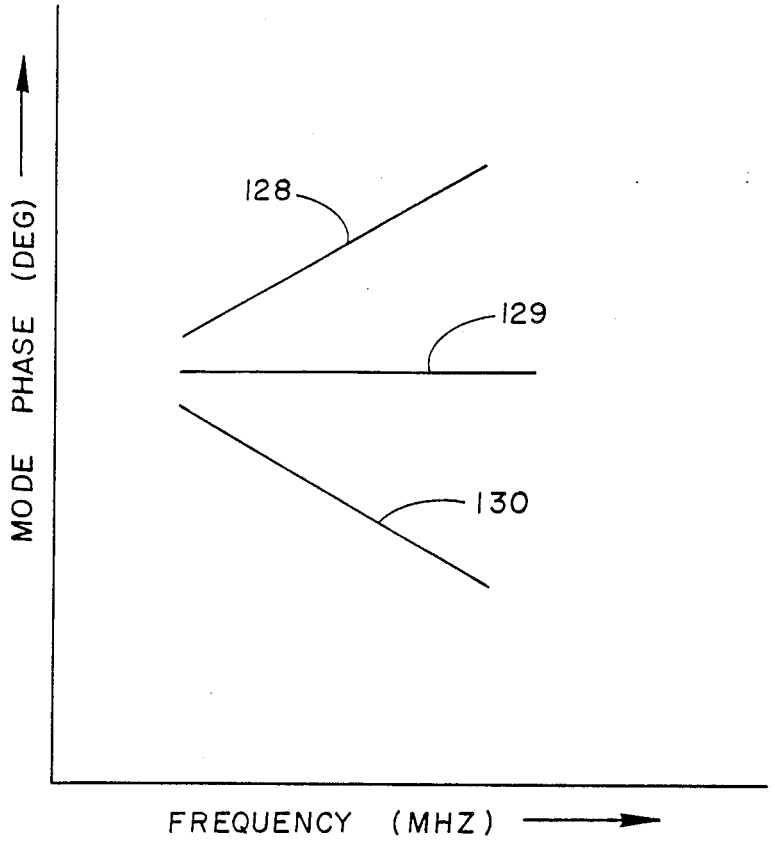
FIG. 4 is a graph of the mode phase bias versus frequency obtained with the apparatus of FIG. 3.

Referring to FIG. 3, a block diagram of the test setup for empirically determining the transmission line length for each mode is shown. In FIG. 3, like references are used for functions corresponding to the apparatus of FIG. 1. A RF network analyzer 118 for example a Hewlett-Packard 8510 Network Analyzer manufactured by the Hewlett-Packard Company includes a sweep generator which functions to provide a signal changing with frequency over lead 120 to an antenna element 121 positioned in the far field with respect to the aperture of circular array antenna 12. Circular array antenna 12 and Butler matrix 14 receive the radiant energy shown by arrow 122 radiated by antenna element 121 and provides a signal in response thereto at each input mode of Butler matrix 14. Each input mode phase of Butler matrix 14 except mode 0, is coupled one at a time over lead 124 to an input of RF network analyzer generator 118. Lead 77 is coupled to a second input to sweep generator 118 wherein the phase of lead 77 is compared with the phase on lead 124 to provide an output on display 126 having a screen 127. If the slope of the curve displayed on display screen 127 has a positive slope as shown by curve 128 in FIG. 4 where the ordinate and abscissa on display screen 127 and FIG. 4 are the same as shown in FIG. 2, then insufficient transmission line length is being used to compensate the more positive slope of the curve of mode phase versus frequency relative to mode 0. The transmission line length, for example a line stretcher, may be mechanically stretched to provide additional length which may be observed after the next sweep of sweep generator 118. The curve shown in display screen 127 will approach horizontal as shown by curve 129 in FIG. 4 and in fact may show a negative slope as shown by curve 130 in FIG. 4 as additional transmission line length is added. The operator may then adjust the transmission line length to the point where the curve on display screen 127 is horizontal. The transmission line length may be measured and a fixed length inserted in its place or the transmission line stretcher may be securely fastened to maintain the line length it had been adjusted to. Curve 128 in FIG. 4 may show for example the initial slope on display screen 127. Curve 129 in FIG. 4 shows the desired horizontal slope showing exact compensation relative to the mode 0 reference and curve 130 in FIG. 4 shows a negative slope where too much transmission line length has been inserted and should be reduced. Fixed phase adjustments are also inserted to bring all modes to the same phase. Normally mode zero is used as the reference phase with respect to the other modes.

Figure 6:
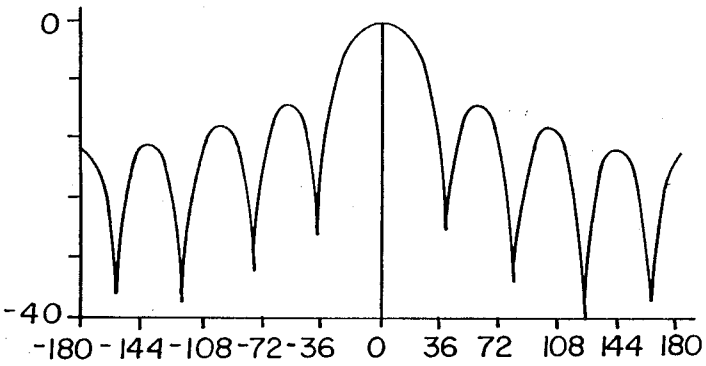
FIG. 5–9 are graphs of the radiated power versus azimuth for various d/λ values.
Figure 5:
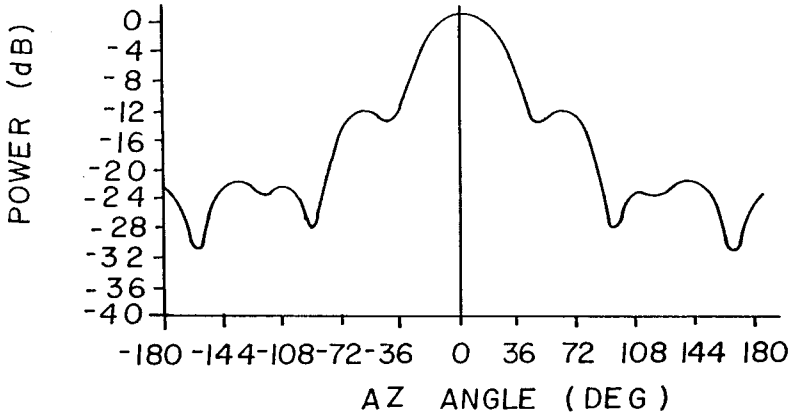
Figure 7:
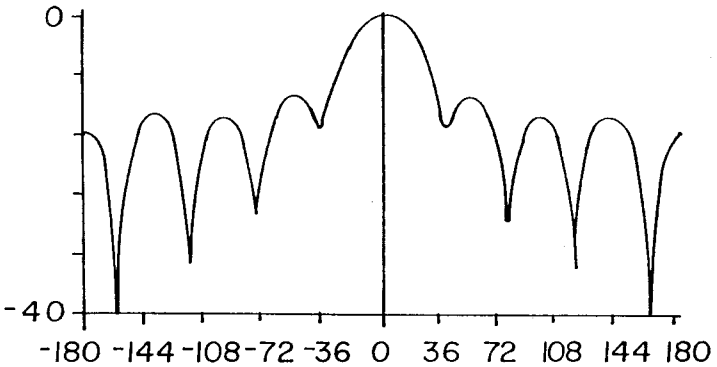
Figure 8:
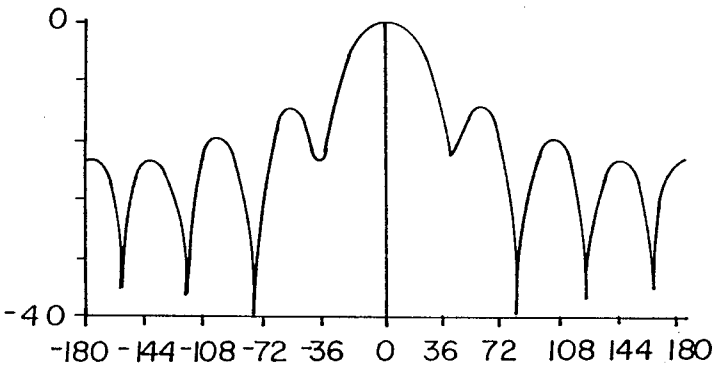
Figure 9:
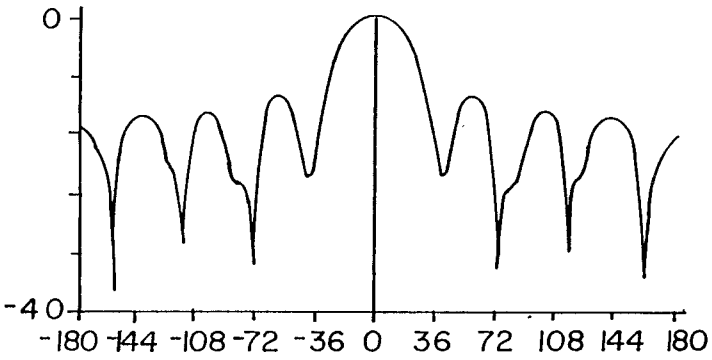

FIGS. 5–9 are graphs of the calculated radiated power versus azimuth for various $d/\lambda$ values for the embodiment shown in FIG. 1. In FIGS. 5–9 the ordinate represents power in decibels and the abscissa represents azimuth angle in degrees from minus 180 degrees to plus 180 degrees. The patterns shown in FIGS. 5–9 were computed as a function of inter-element spacing d i.e. spacing/wavelength, which is the same as computing the pattern as a function of frequency. In FIGS. 5–9 the number of elements was 16; the actual element spacing was 12.88 cm (5.072″); the diameter of the circular array was 66.04 cm (26″); and the frequency was 466 Mhz, 698 Mhz, 931 Mhz, 1164 Mhz, and 1397 Mhz, respectively. FIG. 5 has a $d/\lambda$ spacing equal to 0.2. FIG. 6 has a $d/\lambda$ spacing equal to 0.3. FIG. 7 has a $d/\lambda$ spacing equal to 0.4. FIGS. 8 and 9 have respective $d/\lambda$ spacings of 0.5 and 0.6. In FIGS. 5–9 the beamwidth is nearly constant from $d/\lambda$ equals 0.2 to 0.6, a 1.5 octave band.

A method and apparatus for generating a directional beam having a constant beamwidth over a predetermined frequency bandwidth has been described incorporating a circular array antenna, a Butler matrix coupled to the antenna, a plurality of phase shifters, a plurality of transmission line lengths, and a power divider having at least one input and a plurality of outputs for generating a directional beam, each output of the power divider having a predetermined power attenuation with respect to each input, each respective output of the power divider coupled in series through a respective phase shifter and a respective transmission line length to a respective input mode of the Butler matrix. The transmission line length provides a predetermined phase decrease as a function of frequency of the signals at the inputs of the Butler matrix to compensate for changes in mode phase bias of the Butler matrix and circular array antenna due to frequency changes.

The invention further provides a method for compensating over frequency a circular array antenna coupled to a Butler matrix comprising the steps of coupling a transmission line stretcher to an input mode phase of the Butler matrix, coupling a signal to an antenna in the far field with respect to the circular array antenna, receiving the signal through the circular array antenna and Butler matrix to the respective input mode and comparing the phase of the received mode signal to one of the other modes selected as reference to provide a phase measurement there between and varying the frequency of the signal transmitted over a predetermined frequency range to determine the change in phase difference and adjusting the length of the transmission line stretcher to reduce the change in phase difference over frequency.

What is claimed is:

1. In a circular phased array antenna for generating a steerable directional beam of radio frequency energy, said antenna including:

a plurality of radiating elements disposed circularly;

a Butler matrix having a plurality of outputs and a plurality of mode inputs, each of said Butler matrix outputs being coupled to an individual one of said radiating elements;

a plurality of phase shifters, each of said phase shifters having an input and an output, each said phase shifter output being coupled to an individual one of said mode inputs of said Butler matrix; and a power divider having an input and a plurality of outputs, said power divider input receiving the radio frequency energy to be radiated by said antenna as a directional beam, each said power divider output being coupled to an individual one of said phase shifter inputs;

said phase shifters each providing a phase shift between the input and the output thereof consisting of a fixed phase offset and a steering phase, said Butler matrix, said fixed phase offsets of said phase shifters, and said power divider cooperating to form said directional beam, said directional beam being steerable to different directions according to the particular one of said Butler matrix mode inputs selected for principal excitation by output from said power divider and to the value of said steering phase introduced by each of said phase shifters;

the improvement providing means for compensating for changes in the values of said fixed phase offsets of said phase shifters resulting from changes in the frequency of said energy to be radiated by said antenna whereby said directional characteristics of said antenna are maintained over a broad band of frequencies of said energy, said improvement comprising:

a plurality of transmission lines of predetermined lengths, one each of said transmission lines being connected between one of said outputs of said power divider and one said input of said phase shifters, said predetermined length of each said transmission line being such as to introduce a phase shift between its associated phase shifter and the input mode of said Butler matrix to which said associated phase shifter is connected, which said phase shift varies with the frequency of the energy applied to said transmission line by an amount that is equal and opposite to the change in said fixed phase offset of said associated phase shifter which occurs with a change in the frequency of the energy applied to said associated phase shifter.

2. A method of compensating for changes in the width of a directional beam of a circular phased array antenna caused by changes in the frequency of the radio frequency energy radiated by said antenna, said antenna including:

a plurality of radiating elements disposed circularly;

a Butler matrix having a plurality of outputs and a plurality of mode inputs, said mode inputs being individually identified by a number 1, each of said Butler matrix outputs being coupled to an individual one of said radiating elements;

a plurality of phase shifters, each of said phase shifters having an input and an output, each said phase shifter output being coupled to an individual one, 1, of said mode inputs of said Butler matrix; and a power divider having an input and a plurality of outputs, said power divider input receiving the radio frequency energy to be radiated by said antenna as a directional beam, each said power divider output being coupled to an individual one of said phase shifter inputs;

said phase shifters each providing a phase shift between the input and the output thereof consisting of a fixed phase offset and a steering phase, said Butler matrix, said fixed phase offsets of said phase shifters, and said power divider cooperating to form said directional beam, said directional beam being steerable to different directions according to the particular one of said Butler matrix mode inputs selected for principal excitation by output from said power divider and to the value of said steering phase introduced by each of said phase shifters;

said method comprising:

computing the mode bias $V_l$ for each of said input modes, 1, of said Butler matrix of said antenna to provide said mode bias in the form of:

$$V_l = A_l e^{j\phi l}$$

where:

$V_l$ is the mode bias for the 1th said input mode of said Butler matrix;

$A_l$ is the amplitude of said mode bias for said 1th input mode of said Butler matrix; and $\phi_l$ is the phase of said mode bias for said 1th input mode of said Butler matrix;

adjusting said fixed phase offset of each of said phase shifter associated with each said 1th input mode of said Butler matrix to equal $-\phi_l$ so as to be equal and opposite to said mode bias phase $\phi_l$;

determining $d/df(-\phi_l)$ for each of said fixed phase offsets of each said phase shifter;

where:

$d/df(-\phi_l)$ is the rate of change of said fixed phase offset for said 1th input mode of said Butler matrix with respect to the frequency of the energy applied to said phase shifter;

predetermining the respective lengths, $L_l$, for each of a plurality of transmission lines, one each of said transmission lines for each said 1 input modes of said Butler matrix, such that the rate of change of phase shift with respect to frequency that occurs to energy transmitted by each said transmission line is equal and opposite to said $d/df(-\phi_l)$ for each said fixed phase offset of each said phase shifter; and installing one each of said transmission lines of respective lengths $L_l$ between the one of said phase shifters associated with said input mode 1 of said Butler matrix and said input mode 1 of said Butler matrix.

3. The method as claimed in claim 2, wherein:

said predetermined lengths $L_l$ of said transmission lines are each determined from the relationship;

$$L_l = -\frac{c}{360}\ \frac{d}{df}(-\phi_l)$$

where:

c is the velocity in said transmission line of energy transmitted by said transmission line; and $d/df(-\phi_l)$ is said rate of change of said fixed phase offset for said lth input mode of said Butler matrix.

4. A method of compensating for changes in the width of a directional beam of a circular phased array antenna caused by changes in the frequency of the radio frequency energy radiated by said antenna, said antenna including:

a plurality of radiating elements disposed circularly;

a Butler matrix having a plurality of outputs and a plurality of mode inputs, said mode inputs being individually identified by a number l, each of said Butler matrix outputs being coupled to an individual one of said radiating elements;

a plurality of phase shifters, each of said phase shifters having an input and an output, each said phase shifter output being coupled to an individual one, l, of said mode inputs of said Butler matrix; and a power divider having an input and a plurality of outputs, said power divider input receiving the radio frequency energy to be radiated by said antenna as a directional beam, one each of said power divider outputs being coupled to the input of the individual one of said phase shifters associated with said lth input of said Butler matrix;

said phase shifters each providing a phase shift between the input and the output thereof consisting of a fixed phase offset and a steering phase, said Butler matrix, said fixed phase offsets of said phase shifters, and said power divider cooperating to form said directional beam, said directional beam being steerable to different directions according to the particular one of said Butler matrix mode inputs selected for principal excitation by output from said power divider and to the value of said steering phase introduced by each of said phase shifters;

said method comprising:

installing one each of a plurality of transmission lines of adjustable length between the one said output of said power divider associated with the one of said phase shifters associated with the lth mode input of said Butler matrix;

exciting said antenna with radio frequency energy;

sweeping the frequency of said energy through a relatively broad band of frequencies;

measuring the phase of the energy radiated by said antenna for each said input mode of said Butler matrix while said frequency of said energy is being swept; and adjusting the length of each said transmission line for each said input mode of said Butler matrix until said phase of the energy radiated by said antenna for each said input mode of said Butler matrix remains constant.

5. The method as claimed in claim 4, with the additional step of:

after adjustment of said lengths of said adjustable transmission lines, replacing each said adjustable length transmission lines with a transmission line having a fixed length corresponding to said adjusted length of each said adjustable length transmission line.

* * * * *